US010018102B2

(12) United States Patent
Tokozakura et al.

(10) Patent No.: US 10,018,102 B2
(45) Date of Patent: Jul. 10, 2018

(54) HEAT EXCHANGER FOR VEHICLE

(71) Applicant: TOYOTA JIDOSHA KABUSHIKI KAISHA, Toyota-shi (JP)

(72) Inventors: Daisuke Tokozakura, Susono (JP); Kazuya Arakawa, Numazu (JP); Takahiro Shiina, Fujinomiya (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 108 days.

(21) Appl. No.: 15/220,025

(22) Filed: Jul. 26, 2016

(65) Prior Publication Data

US 2017/0030255 A1 Feb. 2, 2017

(30) Foreign Application Priority Data

Jul. 28, 2015 (JP) ..... 2015-148254

(51) Int. Cl.
*F01P 11/08* (2006.01)
*F28D 9/00* (2006.01)
*F28D 21/00* (2006.01)

(52) U.S. Cl.
CPC ..... *F01P 11/08* (2013.01); *F28D 9/005* (2013.01); *F28D 9/0093* (2013.01); *F01P 2025/40* (2013.01); *F01P 2060/04* (2013.01); *F01P 2060/045* (2013.01); *F28D 2021/0089* (2013.01)

(58) Field of Classification Search
CPC .. F01P 11/08; F01P 2060/04; F01P 2060/045; F28D 9/005; F28D 9/0093; F28D 2021/0091; F01M 5/002
USPC ..... 165/140
See application file for complete search history.

(56) References Cited

U.S. PATENT DOCUMENTS 6,305,466 B1 * 10/2001 Andersson ..... F28D 9/005 165/140
6,502,420 B2 * 1/2003 Gupte ..... F28D 9/0093 165/140
9,581,367 B2 * 2/2017 Mann ..... F25B 39/00
2004/0159424 A1 * 8/2004 Reinke ..... F28D 9/005 165/140
2008/0121381 A1 * 5/2008 So ..... F28D 1/0333 165/140
2013/0133874 A1 5/2013 Kim et al.
(Continued)

FOREIGN PATENT DOCUMENTS

JP 2013-113578 6/2013
JP 2013-120054 6/2013

*Primary Examiner* — Tho V Duong
(74) *Attorney, Agent, or Firm* — Oblon, McClelland, Maier & Neustadt, L.L.P.

(57) ABSTRACT

A heat exchanger includes a plurality of plates that is stacked together to constitute first flow passages, second flow passage, third flow passage, fourth flow passage and fifth flow passage. An engine coolant flows through the first flow passages. An engine oil flows through the second flow passages and fourth flow passages. A transmission oil flows through the third flow passages and fifth flow passages. Triple-flow-passage arrangement layers in each of which each first, second, and third flow passages are disposed, and dual-flow-passage arrangement layers in each of which each fourth and fifth flow passages are disposed are alternately arranged such that flow passages of each same type are not overlaid with one another in a stacking direction of the plates.

5 Claims, 8 Drawing Sheets

(56) References Cited

U.S. PATENT DOCUMENTS

| | | | | |
|---|---|---|---|---|
| 2013/0140017 | A1 | 6/2013 | Kim | |
| 2015/0101781 | A1* | 4/2015 | Kim | F01P 3/12 165/96 |

* cited by examiner

Eng COOLANT OUT
Eng COOLANT IN
Eng OIL IN
Eng OIL OUT
T/M OIL OUT
T/M OIL IN
STACKING DIRECTION
SECOND SIDE
FIRST SIDE
BACK
FRONT
F11
F12
F13
F14
F15
10
11
12
13
14
15
111
112
121
122
131
132
141
142
151
152
x
y
z

HEAT EXCHANGER FOR VEHICLE

INCORPORATION BY REFERENCE

The disclosure of Japanese Patent Application No. 2015-148254 filed on Jul. 28, 2015 including the specification, drawings and abstract is incorporated herein by reference in its entirety.

BACKGROUND

1. Technical Field

The present disclosure relates to a heat exchanger for a vehicle.

2. Description of Related Art

There have been known heat exchangers that are installed in vehicles, and heat-exchange engine coolants with engine oils and with transmission oils so as to adjust temperatures of these oils. Japanese Patent Application Publication No. 2013-113578 discloses a vehicle heat exchanger that includes stacked flow passages through which an engine coolant, an engine oil, and a transmission oil respectively flow, and allows the these fluids to be heat-exchanged with one another. In this vehicle heat exchanger, heat exchange is carried out between the engine coolant and the engine oil, and heat exchange is also carried out between the engine coolant and the transmission oil.

In the vehicle heat exchanger disclosed in JP 2013-113578 A, each flow passage through which the engine oil flows and each flow passage through which the transmission oil flows are arranged in a manner as to interpose each flow passage of the engine coolant therebetween, and thus the engine coolant is heat-exchanged with the engine oil and with the transmission oil in parallel. In other words, the engine coolant is simultaneously heat-exchanged with the engine oil and with the transmission oil.

SUMMARY

In general, a transmission oil has a greater degree of variation in loss relative to variation in oil temperature than that of an engine oil. The degree of variation in loss denotes a degree of loss torque of an engine and a transmission when each oil temperature varies by 1° C., for example. Hence, if both the engine oil and the transmission oil are heat-exchanged with the engine coolant in parallel, both the engine oil and the transmission oil experience variation in loss in accordance with variation in each oil temperature. In light of improvement of fuel efficiency, there is room for improving the above configuration.

The present disclosure provides a heat exchanger for a vehicle capable of enhancing fuel efficiency of an entire power train.

An example aspect of the disclosure provides a heat exchanger for a vehicle including an engine and a transmission. The heat exchanger includes first flow passages configured to bring an engine coolant to flow through the first flow passages; second flow passages configured to bring an engine oil to flow through the second flow passages; third flow passages configured to bring a transmission oil to flow through the third flow passages; fourth flow passages configured to bring the engine oil having flowed through the second flow passages to flow through the fourth flow passages; fifth flow passages configured to bring the transmission oil having flowed through the third flow passages to flow through the fifth flow passages; a plurality of plates configured to partition the first flow passages, the second flow passages, the third flow passages, the fourth flow passages, and the fifth flow passages; a first communicating passage configured to communicate the second flow passages with the fourth flow passages; and a second communicating passage configured to communicate the third flow passages with the fifth flow passages. The first flow passages are configured to bring the engine coolant to be heat-exchanged with both the engine oil in the fourth flow passages and the transmission oil in the fifth flow passages via the plates. The fourth flow passages are configured to bring the engine oil to be heat-exchanged with both the transmission oil in the third flow passages and the engine coolant in the first flow passages via the plates. The fifth flow passages are configured to bring the transmission oil to be heat-exchanged with both the engine oil in the second flow passages and the engine coolant in the first flow passages via the plates. Triple-flow-passage arrangement layers in each of which each first flow passage, each second flow passage, and each third flow passage are disposed in the same layer, and dual-flow-passage arrangement layers in each of which each fourth flow passage and each fifth flow passage are disposed in the same layer are alternately arranged in a stacking direction of the plates in such a manner that flow passages of the same type are not overlaid with one another in the stacking direction of the plates. Each fifth flow passage is disposed upstream of a flow direction of the engine coolant in each first flow passage. Each fourth flow passage is disposed downstream of the flow direction of the engine coolant in each first flow passage. Each third flow passage is disposed upstream of a flow direction of the engine oil in each fourth flow passage. Each first flow passage is disposed downstream of the flow direction of the engine oil in each fourth flow passage. Each second flow passage is disposed upstream of a flow direction of the transmission oil in each fifth flow passage. Each first flow passage is disposed downstream of the flow direction of the transmission oil in each fifth flow passage.

According to the heat exchanger, the transmission oil heat-exchanges with the engine coolant, and then the engine coolant heat exchanges with the engine oil. The transmission oil has a greater variation in loss relative to the variation in oil temperature with the other fluids. Accordingly, for example, in the transmission during warming-up, it is possible to rapidly increase the temperature of the transmission oil, thus reducing the loss of the transmission, and enhancing the fuel efficiency of the entire power train.

According to the above configuration, during high-speed drive or high-load drive of the vehicle, the transmission oil in each third flow passage is heat-exchanged with the engine oil in each fourth flow passage so as to decrease the temperature of the transmission oil; and thereafter, the transmission oil of which temperature is decreased in each fifth flow passage is heat-exchanged with the engine coolant of which temperature is lower than that of the engine oil in each first flow passage so as to rapidly cool the transmission oil of which temperature is higher than that of the engine oil, thereby reducing the loss of the transmission, and enhancing the fuel efficiency of the entire power train.

In the heat exchanger, an inflow port and an outflow port of the engine coolant in the first flow passage, and an inflow port and an outflow port of the engine oil in the fourth flow passage may be arranged such that the flow direction of the engine coolant in each first flow passage and the flow direction of the engine oil in each fourth flow passage are in counter-flow relative to each other.

According to the above configuration, in each heat exchanger, in each first flow passage and each fourth flow passage, the direction in which the engine coolant flows and the direction in which the engine oil flows come into counter-flow relative to each other. As a result, it is possible to maintain the difference in temperature between the fluids partitioned by the plates to be greater compared with the case of the co-flow. Thus, efficiently heat-exchanging the engine coolant with the engine oil In the heat exchanger, an inflow port and an outflow port of the engine coolant in the first flow passage, and an inflow port and an outflow port of the transmission oil in the fifth flow passage may be arranged such that the flow direction of the engine coolant in each first flow passage and the flow direction of the transmission oil in each fifth flow passage are in counter-flow relative to each other.

According to the above configuration, in the heat exchanger, in each first flow passage and each fifth flow passage, the direction in which the engine coolant flows and the direction in which the transmission oil flows come into counter-flow relative to each other. As a result, it is possible to maintain the difference in temperature between the fluids partitioned by the plates to be greater compared with the case of the co-flow. Thus, the engine coolant heat-exchanges with the transmission oil efficiently.

In the heat exchanger, an inflow port and an outflow port of the engine oil in the second flow passage, and an inflow port and an outflow port of the transmission oil in the fifth flow passage may be arranged such that the flow direction of the engine oil in each second flow passage and the flow direction of the transmission oil in each fifth flow passage are in counter-flow relative to each other.

According to the above configuration, in the heat exchanger, in each second flow passage and each fifth flow passage, the direction in which the engine oil flows and the direction in which the transmission oil flows come into counter-flow relative to each other. As a result, it is possible to maintain the difference in temperature between the fluids partitioned by the plates to be greater compared with the case of the co-flow. Thus, the engine oil heat-exchanges with the transmission oil efficiently.

In the heat exchanger, an inflow port and an outflow port of the engine oil in the second flow passage, and an inflow port and an outflow port of the transmission oil in the fifth flow passage may be arranged such that the flow direction of the engine oil in each second flow passage and the flow direction of the transmission oil in each fifth flow passage are in counter-flow relative to each other.

According to the above configuration, in the heat exchanger, in each fourth flow passage and each third flow passage, the direction in which the engine oil flows and the direction in which the transmission oil flows come into counter-flow relative to each other. As a result, it is possible to maintain the difference in temperature between the fluids partitioned by the plates to be greater compared with the case of the co-flow. Thus, the engine oil heat-exchanges with the transmission oil efficiently.

According to the heat exchanger, the respective flow passages are arranged in consideration of the variation in loss relative to each variation in oil temperature of the engine oil and the transmission oil, thereby optimizing each heat-exchange amount of the engine coolant, the engine oil, and the transmission oil; therefore, it is possible to reduce the loss of the engine and the transmission, and enhance the fuel efficiency of the entire power train.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

A heat exchanger for a vehicle according to an embodiment will be described with reference to FIGS. 1A to 12, hereinafter. The embodiment is not limited to the following examples. Components in the following embodiment include components that are easily replaceable by those skilled in the art or substantially the same components.

The heat exchanger according to the embodiment is a so-called three-phase heat exchanger that is installed on a vehicle and heat-exchanges three types of fluids: an engine coolant (hereinafter, referred to as an Eng coolant); an engine oil (hereinafter, referred to as an Eng oil); and a transmission oil (hereinafter, referred to as a T/M oil) with one another. As shown in FIGS. 1A to 2D, the heat exchanger 1 is a plate-stacking heat exchanger formed by stacking a plurality of plates 10 made of metal, such as aluminum, and integrally joining these plates. A vehicle in which the heat exchanger 1 is installed is an AT vehicle, a CVT vehicle, or an HV vehicle (also the same in a "vehicle" in the following descriptions), for example. FIGS. 1A to 2D mainly show respective flow passages of fluids that are heat-exchanged with one another in the heat exchanger 1, and configurations other than those of the flow passages are appropriately omitted or simplified.

Figure 1A:
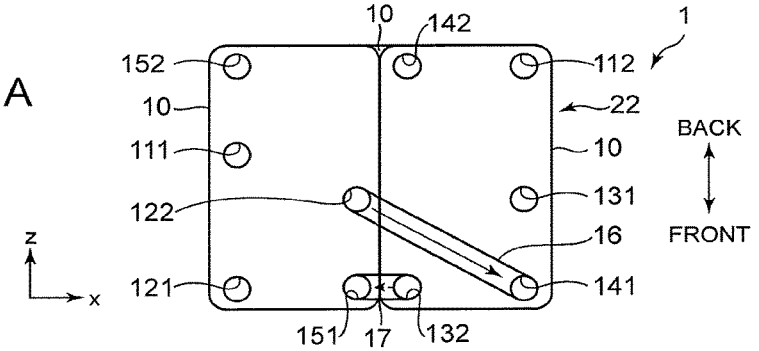
FIGS. 1A to 1C are schematic drawings schematically showing configurations of a heat exchanger according to an embodiment, and showing a plan view, a front view, and a bottom view thereof in order from the top.
Figure 1B:
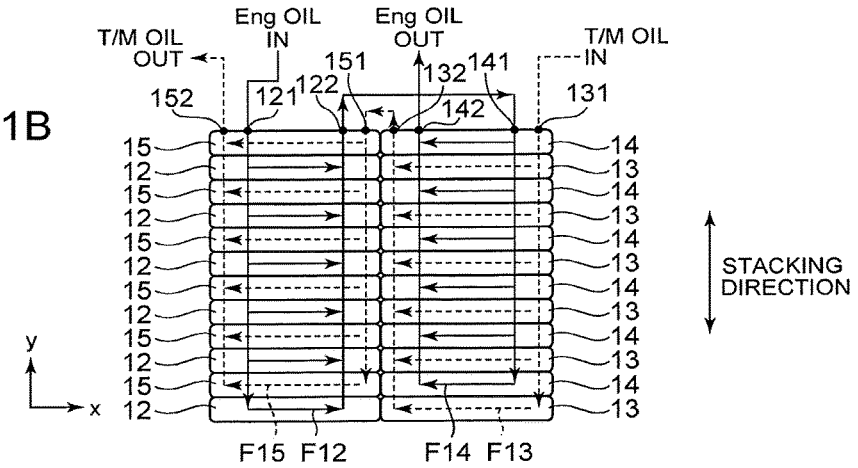
Figure 1C:
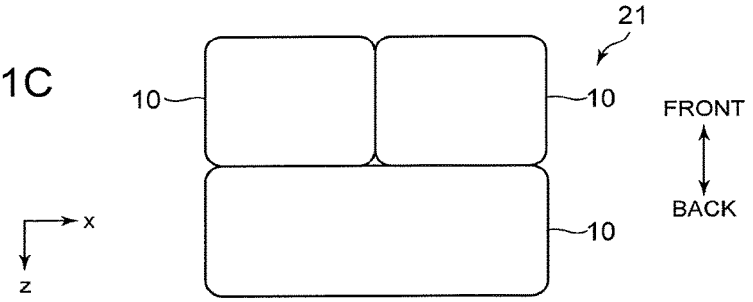
Figures 2A, 2B, 2C, 2D:
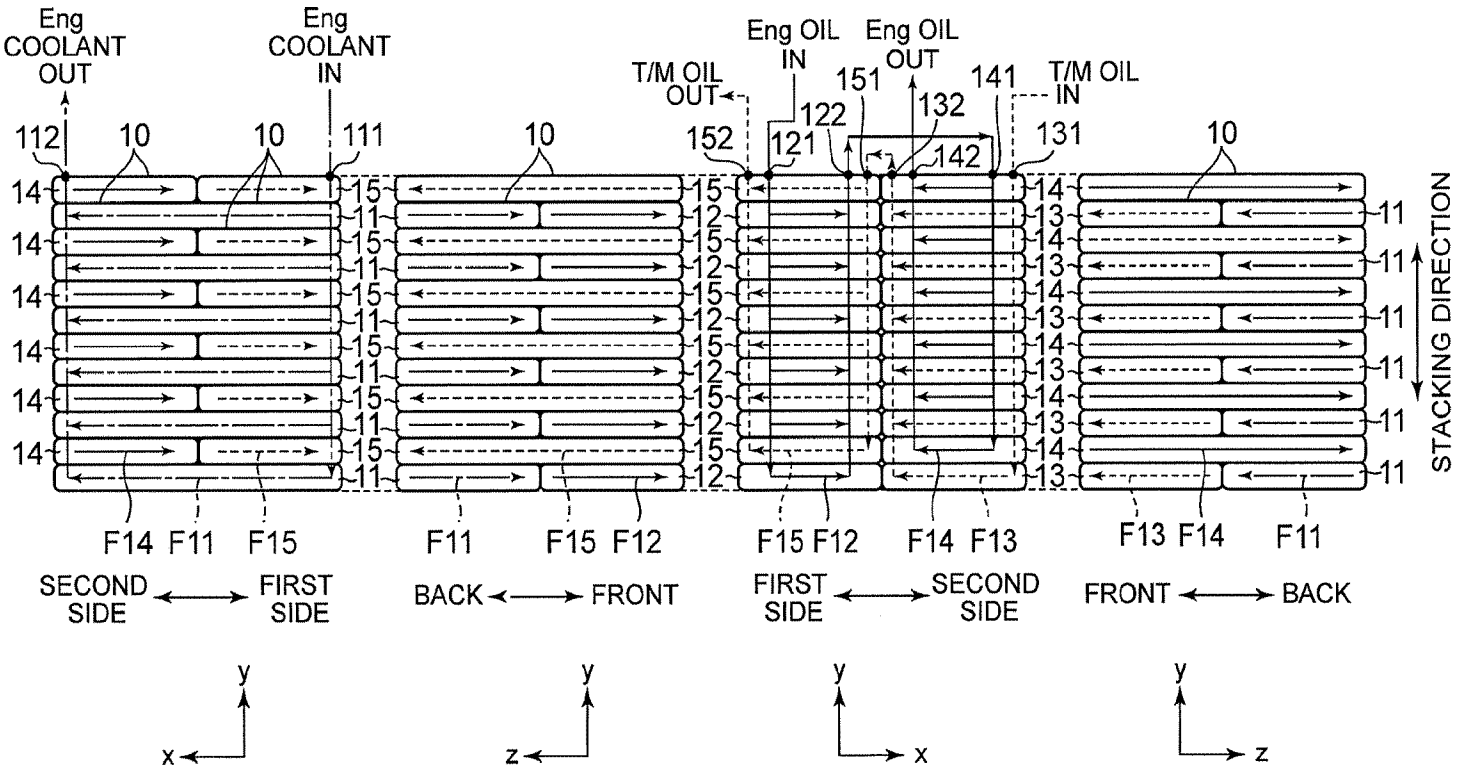
FIGS. 2A to 2D are schematic drawings schematically showing the configurations of the heat exchanger according to the embodiment, and showing a back view, a first side view, the front view, and a second side view thereof in order from the left.

An outline of each flow passage will be described. In the heat exchanger 1, as shown in FIGS. 1A to 2D, the plurality of plates 10 are so stacked as to form a plurality of flow passages each of which is formed between each two plates 10. In the present embodiment, there are provided five types of flow passages: first flow passages 11, second flow passages 12, third flow passages 13, fourth flow passages 14, and fifth flow passages 15. As shown in FIGS. 1A to 1C, the heat exchanger 1 includes a first communicating passage 16 that communicates the second flow passages 12 with the fourth flow passages 14, and a second communicating passage 17 that communicates the third flow passages 13 with the fifth flow passages 15. In FIGS. 2A to 2D, using a front view that is the second drawing from the right of FIGS. 2A to 2D as a reference, a side on which the second flow passages 12 and the fifth flow passages 15 are arranged (on the left of the drawing in this front view) is defined as a first side, and a side on which the third flow passages 13 and the fourth flow passages 14 are arranged (on the right of the drawing in this front view) is defined as a second side.

Each "flow passage" denotes a space partitioned by the plates 10. In the drawing, each alternate long and short dash line arrow indicates a flow direction F11 of the Eng coolant in each first flow passage 11, respective solid line arrows indicate flow directions F12, F14 of the Eng oil in each second flow passage 12 and in each fourth flow passage 14, and respective broken line arrows indicate flow directions F13, F15 of the T/M oil in each third flow passage 13 and in each fifth flow passage 15. Each "flow direction" denotes a direction of flowing from an inflow port of each flow passage toward an outflow port thereof (see FIG. 7 and FIG. 9 described later).

Each first flow passage 11, each second flow passage 12, each third flow passage 13, each fourth flow passage 14, and each fifth flow passage 15 are isolated and partitioned from one another by the plates 10 so as to prevent the respective fluids flowing through the corresponding flow passages from being mixed to one another. As shown in FIGS. 1A to 2D, the heat exchanger 1 is configured by twelve layers in total, and each fourth flow passage 14 and each fifth flow passage 15 are adjacently arranged in each of the first, the third, the fifth, the seventh, the ninth, and the eleventh layers from the top, and each first flow passage 11, each second flow passage 12 and each third flow passage 13 are adjacently arranged in each of the second, the fourth, the sixth, the eighth, the tenth, and the twelfth layers from the top, respectively. The heat exchanger 1 is configured such that the same type of the flow passages communicate with one another thereinside so that the same type of fluids can flow therethrough in the stacking direction of the plates 10. The specific configuration of the plates 10 for implementing the above described flow passages will be described later; and first, the configuration of each flow passage will be described, hereinafter.

The first flow passages 11 are flow passages through which the Eng coolant flows. As shown in FIGS. 2A to 2D, each first flow passage 11 is formed on a part of a surface of each layer if the heat exchanger 1 is viewed in a plan view in a direction orthogonal to the stacking direction of the plates 10, and formed with an area substantially equivalent to a summed area of the area of each second flow passage 12 and the area of each third flow passage 13. The "area" herein denotes an area in the direction orthogonal to the stacking direction of the plates 10 (the same in an "area" in the following descriptions).

As shown in FIGS. 1A to 2D, the plate 10 configuring the uppermost part of the heat exchanger 1 is provided with a first inflow port 111 used for introducing the Eng coolant from the outside (engine) into the first flow passages 11, and a first outflow port 112 used for discharging the Eng coolant from the first flow passages 11 to the outside (engine). The Eng coolant introduced from the first inflow port 111 into the first flow passage 11 flows downward in the stacking direction of the plates 10, and is split into each first flow passage 11 in each layer (the second, the fourth, the sixth, the eighth, the tenth, and the twelfth layers from the top in FIGS. 1A to 2D). The Eng coolant flows through the first flow passage 11 in each layer, and thereafter, flows upward in the stacking direction of the plates 10 to be joined together, and flows out from the first outflow port 112 to the outside of the heat exchanger 1.

Although not shown in the drawing, each first flow passage 11 in each layer is provided with an inter-layer communicating passage formed in a manner as to extend through each first flow passage 11 for the purpose of allowing the Eng oil to communicate between the fourth flow passages 14 arranged above and below each first flow passage 11. Similarly, the first flow passage 11 in each layer is also provided with an inter-layer communicating passage formed in a manner as to extend through the first flow passage 11 for the purpose of allowing the T/M oil to communicate between the fifth flow passages 15 arranged above and below each first flow passage 11. The inter-layer communicating passages are passages through which the Eng oil flows in the stacking direction in each first flow passage 11, and formed at a position corresponding to the fourth outflow port 142 if each first flow passage 11 is viewed in a plan view in the direction orthogonal to the stacking direction of the plates 10, and a passage through which the T/M oil flows in the stacking direction, and is formed at a position corresponding to the fifth outflow port 152 if each first flow passage 11 is viewed in a plan view in the direction orthogonal to the stacking direction of the plates 10 (see FIG. 7).

The second flow passages 12 are flow passages through which the Eng oil flows. As shown in FIGS. 1A to 2D, each second flow passage 12 is formed on a part of a surface of each layer if the heat exchanger 1 is viewed in a plan view in the direction orthogonal to the stacking direction of the plates 10, and formed with an area that is equivalent to the area of each third flow passage 13, and that is a half of the area of each fourth flow passage 14 or of the area of each fifth flow passage 15.

As shown in FIGS. 1A to 2D, the plate 10 configuring the uppermost part of the heat exchanger 1 is provided with a second inflow port 121 used for introducing the Eng oil from the outside (engine) into the second flow passages 12, and a second outflow port 122 used for discharging the Eng oil from the second flow passages 12 to the first communicating passage 16. The Eng oil introduced from the second inflow port 121 into the second flow passage 12 flows downward in the stacking direction of the plates 10, and is split into each second flow passage 12 in each layer (the second, the fourth, the sixth, the eight, the tenth, and the twelfth layers from the top in FIGS. 1A to 2D). The Eng oil flows through the second flow passage 12 in each layer, and thereafter, flows upward in the stacking direction of the plates 10 to be joined together, and flows out from the second outflow port 122 to the outside of the heat exchanger 1.

Although not shown in the drawing, each second flow passage 12 in each layer is provided with an inter-layer communicating passage formed in a manner as to extend through each second flow passage 12 for the purpose of allowing the T/M oil to communicate between the fifth flow passages 15 arranged above and below each second flow passage 12. This inter-layer communicating passage is a passage through which the T/M oil flows in the stacking direction in each second flow passage 12, and formed at a position corresponding to the fifth inflow port 151 if each second flow passage 12 is viewed in a plan view in the direction orthogonal to the stacking direction of the plates 10 (see FIG. 9 described later).

The third flow passages 13 are flow passages through which the T/M oil flows. As shown in FIGS. 1A to 2D, each third flow passage 13 is formed on a part of a surface of each layer if the heat exchanger 1 is viewed in a plan view in the direction orthogonal to the stacking direction of the plates 10, and formed with an area that is equivalent to the area of each second flow passage 12, and that is a half of the area of each fourth flow passage 14 or of the area of each fifth flow passage 15.

As shown in FIGS. 1A to 2D, the plate 10 configuring the uppermost part of the heat exchanger 1 is provided with a third inflow port 131 used for introducing the T/M oil from the outside (transmission) into the third flow passages 13, and a third outflow port 132 used for discharging the T/M oil from the third flow passages 13 to the second communicating passage 17. The T/M oil introduced from the third inflow port 131 into the third flow passage 13 flows downward in the stacking direction of the plates 10, and is split into each third flow passage 13 in each layer (the second, the fourth, the sixth, the eighth, the tenth, the twelfth layers from the top in FIGS. 1A to 2D). The T/M oil flows through the third flow passage 13 in each layer, and thereafter, flows upward in the stacking direction of the plates 10 to be joined together, and flows out from the third outflow port 132 to the second communicating passage 17.

Although not shown in the drawing, each third flow passage 13 in each layer is provided with an inter-layer communicating passage formed in a manner as to extend through each third flow passage 13 for the purpose of allowing the Eng oil to communicate between the fourth flow passages 14 arranged above and below each third flow passage 13. This inter-layer communicating passage is a passage through which the Eng oil flows in the stacking direction in each third flow passage 13, and formed at a position corresponding to the fourth inflow port 141 if each third flow passage 13 is viewed in a plan view in the direction orthogonal to the stacking direction of the plates 10 (see FIG. 9 described later).

The fourth flow passages 14 are flow passages through which the Eng oil having flowed through the second flow passages 12 flows. As shown in FIGS. 1A to 1C, each fourth flow passage 14 is formed on a part of a surface of each layer if the heat exchanger 1 is viewed in a plan view in the direction orthogonal to the stacking direction of the plates 10, and formed with an area equivalent to the area of each fifth flow passage 15.

As shown in FIGS. 1A to 2D, the plate 10 configuring the uppermost part of the heat exchanger 1 is provided with a fourth inflow port 141 used for introducing the Eng oil from the first communicating passage 16 into the fourth flow passages 14, and a fourth outflow port 142 used for discharging the Eng oil from the fourth flow passages 14 to the outside (engine). Specifically, the Eng oil previously heat-exchanged in the second flow passages 12 with the T/M oil flowing through the fifth flow passages 15 flows into the fourth flow passages 14 via the first communicating passage 16. The Eng oil introduced from the fourth inflow port 141 into the fourth flow passage 14 flows downward in the stacking direction of the plates 10, and is split into each fourth flow passage 14 in each layer (the first, the third, the fifth, the seventh, the ninth, and the eleventh layers from the top in FIGS. 1A to 2D). The Eng oil flows through each fourth flow passage 14 in each layer, and thereafter, flows upward in the stacking direction of the plates 10 to be joined together, and flows out from the fourth outflow port 142 to the outside of the heat exchanger 1.

Although not shown in the drawing, each fourth flow passage 14 in each layer is provided with an inter-layer communicating passage formed in a manner as to extend through each fourth flow passage 14 for the purpose of allowing the Eng coolant to communicate between the first flow passages 11 arranged above and below each fourth flow passage 14. Similarly, the fourth flow passage 14 in each layer is provided with inter-layer communicating passages formed in a manner as to extend through the fourth flow passage 14 for the purpose of allowing the T/M oil to communicate between the third flow passages 13 arranged above and below each fourth flow passage 14. In each fourth flow passage 14, the inter-layer communicating passages are passages through which the Eng coolant flows in the stacking direction, and formed at a position corresponding to the first outflow port 112 if each fourth flow passage 14 is viewed in a plan view in the direction orthogonal to the stacking direction of the plates 10 (see FIG. 7 described later), and passages through which the T/M oil flows in the stacking direction, and formed at positions corresponding to the third inflow port 131 and the third outflow port 132 if each fourth flow passage 14 is viewed in a plan view in the direction orthogonal to the stacking direction of the plates 10 (see FIG. 9).

The fifth flow passages 15 are flow passages through which the TIM oil having flowed through the third flow passages 13 flows. As shown in FIGS. 1A to 1C, each fifth flow passage 15 is formed on a part of a surface of each layer if the heat exchanger 1 is viewed in a plan view in the direction orthogonal to the stacking direction of the plates 10, and formed with an area equivalent to the area of each fourth flow passage 14.

As shown in FIGS. 1A to 2D, the plate 10 configuring the uppermost part of the heat exchanger 1 is provided with a fifth inflow port 151 used for introducing the T/M oil from the second communicating passage 17 into the fifth flow passages 15, and a fifth outflow port 152 used for discharging the T/M oil from the fifth flow passages 15 to the outside (transmission). Specifically, the TIM oil previously heat-exchanged in the third flow passages 13 with the Eng oil flowing through the fourth flow passages 14 flows into the fifth flow passages 15 via the second communicating passage 17. The T/M oil introduced from the fifth inflow port 151 into the fifth flow passage 15 flows downward in the stacking direction of the plates 10, and is split into each fifth flow passage 15 in each layer (the first, the third, the fifth, the seventh, the ninth, and the eleventh layers from the top in FIGS. 1A to 2D). The T/M oil flows through each fifth flow passage 15 in each layer, and thereafter, flows upward in the stacking direction of the plates 10 to be joined together, and flows out from the fifth outflow port 152 to the outside of the heat exchanger 1.

Although not shown in the drawing, each fifth flow passage 15 in each layer is provided with an inter-layer communicating passage formed in a manner as to extend through each fifth flow passage 15 for the purpose of allowing the Eng coolant to communicate between the first flow passages 11 arranged above and below each fifth flow passage 15. Similarly, the fifth flow passage 15 in each layer is provided with inter-layer communicating passages formed in a manner as to extend through the fifth flow passage 15 for the purpose of allowing the Eng oil to communicate between the second flow passages 12 arranged above and below each fifth flow passage 15. In each fifth flow passage 15, the inter-layer communicating passages are passages through which the Eng coolant flows in the stacking direction, and formed at a position corresponding to the first inflow port 111 if each fifth flow passage 15 is viewed in a plan view in the direction orthogonal to the stacking direction of the plates 10 (see FIG. 7 described later), and passages through which the Eng oil flows in the stacking direction, and formed at positions corresponding to the second inflow port 121 and second outflow port 122 if each fifth flow passage 15 is viewed in a plan view in the direction orthogonal to the stacking direction of the plates 10 (see FIG. 9 described later).

The first communicating passage 16 is a flow passage configured to communicate the second flow passages 12 with the fourth flow passages 14. As shown in FIGS. 1A to 1C, the first communicating passage 16 is provided to extend from the second outflow port 122 to the fourth inflow port 141 so that the Eng oil flowing out from the second outflow port 122 flows through the first communicating passage 16 into the fourth flow passages 14 from the fourth inflow port 141.

The second communicating passage 17 is a flow passage configured to communicate the third flow passages 13 with the fifth flow passages 15. As shown in FIGS. 1A to 1C, the second communicating passage 17 is provided to extend from the third outflow port 132 to the fifth inflow port 151 so that the T/M oil flowing out from the third outflow port 132 flows through the second communicating passage 17 into the fifth flow passages 15 from the fifth inflow port 151.

Arrangements of the respective flow passages will be described, hereinafter. As shown in FIGS. 1A to 2D, each first flow passage 11, each second flow passage 12, and each third flow passage 13 are adjacently disposed in the same single layer which is different from each layer in which each fourth flow passage 14 and each fifth flow passage 15 are disposed. Herein, each same layer in which each first flow passage 11, each second flow passage 12, and each third flow passage 13 are adjacently arranged in the above manner is defined as a "triple-flow-passage arrangement layer 21".

As shown in FIGS. 1A to 2D, each fourth flow passage 14 and each fifth flow passage 15 are adjacently disposed in the same single layer which is different from each layer in which each first flow passage 11, each second flow passage 12, and each third flow passage 13 are disposed. Herein, each same layer in which each fourth flow passage 14 and each fifth flow passage 15 are adjacently arranged in the above manner is defined as a "dual-flow-passage arrangement layer 22". In the heat exchanger 1, as shown in these drawings, each triple-flow-passage arrangement layer 21 and each dual-flow-passage arrangement layer 22 are alternately arranged in the stacking direction of the plates 10 in such a manner that the same types of flow passages are not overlaid with one another in the stacking direction of the plates 10.

In each triple-flow-passage arrangement layer 21, each first flow passage 11, each second flow passage 12, and each third flow passage 13 that are adjacent to one another are respectively isolated from one another by the plates 10; therefore, no heat exchange is carried out among the Eng coolant flowing through each first flow passage 11, the Eng oil flowing through each second flow passage 12, and the T/M oil flowing through each third flow passage 13. Similarly, in each dual-flow-passage arrangement layer 22, each fourth flow passage 14 and each fifth flow passage 15 that are adjacent to each other are respectively isolated from each other by the plates 10; therefore, no heat exchange is carried out between the Eng oil flowing through each fourth flow passage 14 and the T/M oil flowing through each fifth flow passage 15.

For example, as shown in FIG. 2 (back view) and FIG. 7 described later, each first flow passage 11 is configured to be in contact with a part of each fourth flow passage 14 and a part of each fifth flow passage 15 via the plates 10. Accordingly, the Eng coolant in each first flow passage 11 can mutually be heat-exchanged with both the Eng oil in each fourth flow passage 14 and the T/M oil in each fifth flow passage 15 via the plates 10.

As shown in FIG. 2 (back view), in the heat exchanger 1, each fifth flow passage 15 is disposed upstream of the flow direction F11 of the Eng coolant in each first flow passage 11, and each fourth flow passage 14 is disposed downstream of the flow direction F11 of the Eng coolant in each first flow passage 11. Hence, the Eng coolant flowing through each first flow passage 11 is first heat-exchanged with the T/M oil flowing through each fifth flow passage 15 via the plates 10, and thereafter, is heat-exchanged with the Eng oil flowing through each fourth flow passage 14 via the plates 10.

Figure 7:
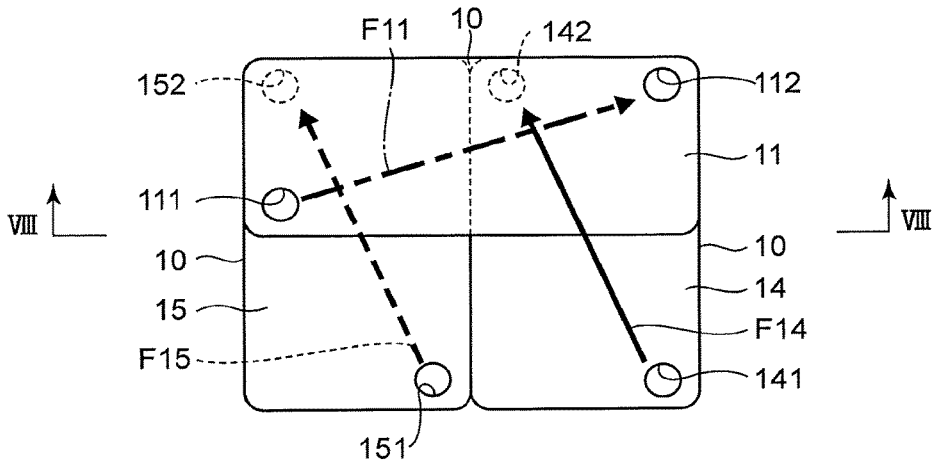
FIG. 7 is a drawing schematically showing the flow direction of the engine coolant in each first flow passage, a flow direction of the engine oil in each fourth flow passage, and a flow direction of the transmission oil in each fifth flow passage in the heat exchanger according to the embodiment.

"Upstream of the flow direction F11 of the Eng coolant" denotes a position on the side from which the Eng coolant flows in, and more specifically, this position denotes a position located on the first inflow port 111 side from which the Eng coolant flows in (see FIG. 7 for more details). "Downstream of the flow direction F11 of the Eng coolant" denotes a position on the side from which the Eng coolant flows out, and more specifically, this position denotes a position located on the first outflow port 112 side from which the Eng coolant flows out (see FIG. 7 for more details).

As shown in FIG. 2 (the second side view), FIG. 7 and FIG. 9 described later, each fourth flow passage 14 is configured to be in contact with an entire part of each third flow passage 13 and a part of each first flow passage 11 via the plates 10. Accordingly, the Eng oil in each fourth flow passage 14 can mutually be heat-exchanged with both the T/M oil in each third flow passage 13 and the Eng coolant in each first flow passage 11 via the plates 10.

In the heat exchanger 1, as shown in FIG. 2 (the second side view), each third flow passage 13 is disposed upstream of the flow direction F14 of the Eng oil in each fourth flow passage 14, and each first flow passage 11 is disposed downstream of the flow direction F14 of the Eng oil in each fourth flow passage 14. Hence, the Eng oil flowing through each fourth flow passage 14 is first heat-exchanged with the T/M oil flowing through each third flow passage 13 via the plates 10, and thereafter, is heat-exchanged with the Eng coolant flowing through each first flow passage 11 via the plates 10.

Figure 9:
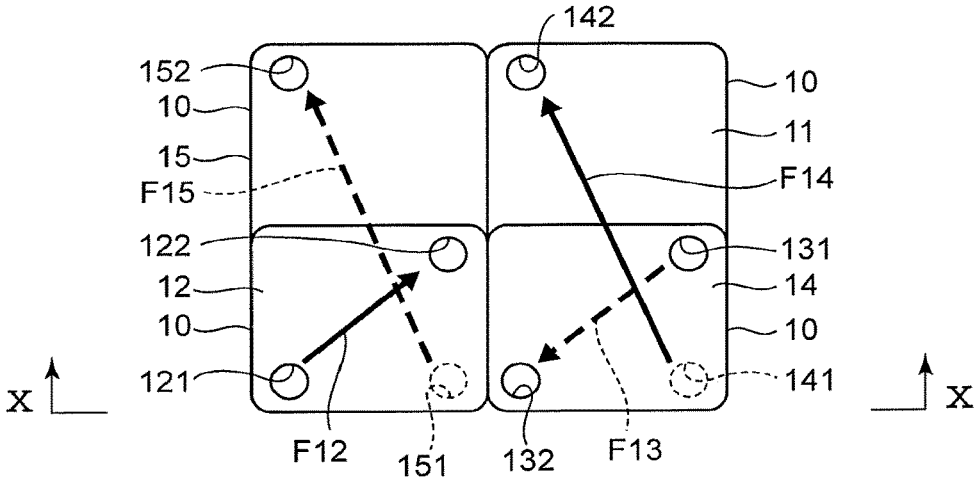
FIG. 9 is a drawing schematically showing a flow direction of the engine oil in each second flow passage, a flow direction of the transmission oil in each third flow passage, a flow direction of the engine oil in each fourth flow passage, and a flow direction of the transmission oil in each fifth flow passage in the heat exchanger according to the embodiment.

"Upstream of the flow direction F14 of the Eng oil" denotes a position on the side from which the Eng oil flows in, and more specifically, this position denotes a position located on the fourth inflow port 141 side from which the Eng oil flows in (see FIG. 7 and FIG. 9 for more details). "Downstream of the flow direction F14 of the Eng oil" denotes a position on the side from which the Eng oil flows out, and more specifically, this position denotes a position located on the fourth outflow port 142 side from which the Eng oil flows out (see FIG. 7 and FIG. 9 for more details).

As shown in FIG. 2 (the first side view), FIG. 7 and FIG. 9 described later, each fifth flow passage 15 is configured to be in contact with an entire part of each second flow passage 12 and a part of each first flow passage 11 via the plates 10. Accordingly, the T/M oil in each fifth flow passage 15 can mutually be heat-exchanged with both the Eng oil in each second flow passage 12 and the Eng coolant in each first flow passage 11 via the plates 10.

In the heat exchanger 1, as shown in FIG. 2 (the first side view), each second flow passage 12 is disposed upstream of the flow direction F15 of the T/M oil in each fifth flow passage 15, and each first flow passage 11 is disposed downstream of the flow direction F15 of the T/M oil in each fifth flow passage 15. Hence, the T/M oil flowing through each fifth flow passage 15 is first heat-exchanged with the Eng oil flowing through each second flow passage 12 via the plates 10, and thereafter, is heat-exchanged with the Eng coolant flowing through each first flow passage 11 via the plates 10.

"Upstream of the flow direction F15 of the T/M oil" denotes a position on the side from which the T/M oil flows in, and more specifically, this position denotes a position located on the fifth inflow port 151 side from which the T/M oil flows in (see FIG. 7 and FIG. 9 for more details). "Downstream of the flow direction F15 of the T/M oil" denotes a position on the side from which the T/M oil flows out, and more specifically, this position denotes a position located on the fifth outflow port 152 side from which the T/M oil flows out (see FIG. 7 and FIG. 9 for more details).

Figure 3:
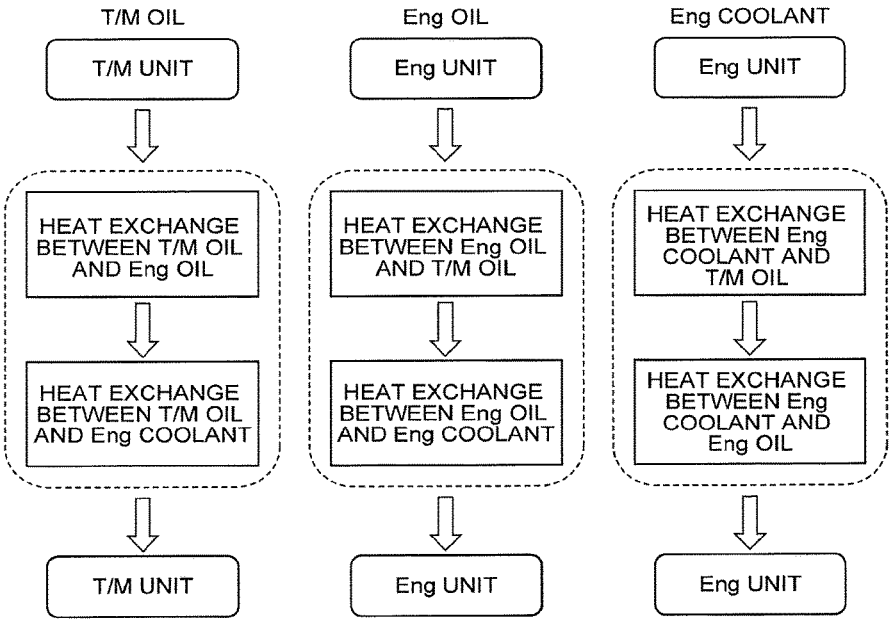
FIG. 3 is a drawing showing each heat exchange procedure of an engine coolant, a transmission oil, and an engine oil in the heat exchanger according to the embodiment.

The heat exchange procedures of the respective fluids in the corresponding flow passages of the heat exchanger 1 are collectively illustrated in FIG. 3. Specifically, as shown in this drawing, the T/M oil flowing from the T/M unit into each third flow passage 13 is first heat-exchanged with the Eng oil in each fourth flow passage 14. The T/M oil then flows from the third flow passages 13 into the fifth flow passages 15 through the second communicating passage 17, and thereafter, is heat-exchanged with the Eng coolant of each first flow passage 11, and is then returned into the T/M unit.

As shown in FIG. 3, the Eng oil flowing from the Eng unit into each second flow passage 12 is first heat-exchanged with the T/M oil in each fifth flow passage 15. The Eng oil then flows from the second flow passages 12 into the fourth flow passages 14 through the first communicating passage 16, and thereafter, is heat-exchanged with the Eng coolant of each first flow passage 11, and is then returned into the Eng unit. As shown in FIG. 3, the Eng coolant flowing from the Eng unit into each first flow passage 11 is first heat-exchanged with the T/M oil of each fifth flow passage 15, and subsequently, the Eng coolant is heat-exchanged with the Eng oil of each fourth flow passage 14, and is then returned into the Eng unit. In this manner, in the heat exchanger 1, three types of the fluids are heat-exchanged with one another while flowing through five types of the flow passages.

Figure 4:
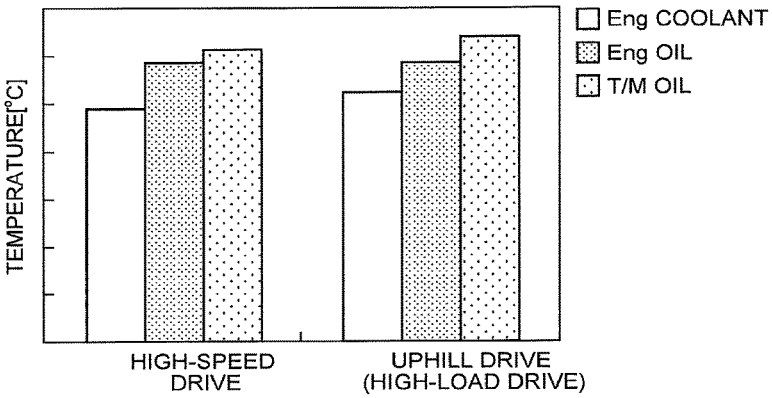
FIG. 4 is a graph showing each maximum temperature of the respective fluids during high-speed drive and uphill drive of the vehicle.

FIG. 4 shows maximum temperatures of the respective fluids during high-speed drive and uphill drive of the vehicle. As shown in FIG. 4, during the high-speed drive or during the high-load drive, such as uphill drive, of the vehicle, the oil temperature of the T/M oil becomes higher than the oil temperature of the Eng oil. Hence, during the high-speed drive or during the high-load drive of the vehicle, the T/M oil is required to be cooled more than (have a lower temperature than that of) the Eng oil; therefore, the heat-exchange amount between the Eng coolant and the T/M oil is required to be increased. Specifically, during the high-speed drive and during the uphill drive of the vehicle, it is necessary to increase the cooling performance (heat-exchange amount) by the Eng coolant relative to the T/M oil rather than relative to the Eng oil. To attain this, in the heat exchanger 1, the Eng oil of each fourth flow passage 14 is first heat-exchanged with the T/M oil of each third flow passage 13 so as to cool the T/M oil, and thereafter, the Eng coolant of each first flow passage 11 is heat-exchanged with the T/M of each fifth flow passage 15, thereby efficiently cooling the T/M oil.

Figure 5:
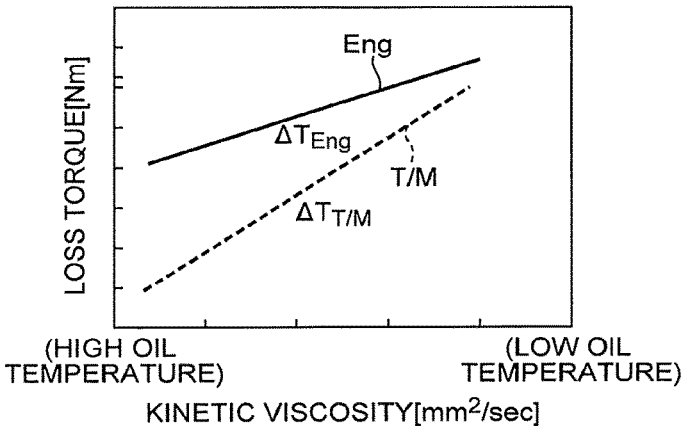
FIG. 5 is a graph showing a relation between respective loss torques of an engine and a transmission in the vehicle and respective kinetic viscosities of the engine oil and the transmission oil.

Meanwhile, as aforementioned, the degree of variation in loss relative to variation in oil temperature is different between the Eng oil and the T/M oil. For example, FIG. 5 shows respective relations between the loss torque and the oil temperature in the vehicle, a vertical axis represents a loss torque, a horizontal axis represents a kinetic viscosity, a solid line represents a relation between a kinetic viscosity and a loss torque in the Eng oil, and a broken line represents a relation between a kinetic viscosity and a loss torque in the T/M oil. In this drawing, $\Delta T_{Eng}$ represents an inclination of the loss torque of the engine relative to the variation in kinetic viscosity, and $\Delta T_{T/M}$ represents an inclination of the loss torque of the transmission relative to the variation in kinetic viscosity.

In FIG. 5, although the horizontal axis does not represent the oil temperature but represents the kinetic viscosity, the kinetic viscosity has a temperature-dependency; therefore, FIG. 5 may be deemed to show the variation in loss relative to the variation in oil temperature (High Oil Temperature) and (Low Oil Temperature) indicated on the left and the right of the horizontal axis of FIG. 5 represent that the kinetic viscosity becomes lower as the oil temperature becomes higher, and the kinetic viscosity becomes higher as the oil temperature becomes lower.

As shown in FIG. 5, in both the engine and the transmission, as the kinetic viscosity becomes decreased (the oil temperature becomes increased), the loss torque becomes decreased. Meanwhile, the inclination of the loss torque relative to the variation in oil temperature has a relation of $\Delta T_{T/M} > \Delta T_{Eng}$, and thus the inclination of the loss torque of the transmission is steeper than the inclination of the loss torque of the engine. Consequently, it is possible to reduce more loss torque of the entire power train, for example, by increasing the oil temperature of the T/M oil by 1° C. rather than by increasing the oil temperature of the Eng oil by 1° C., thus improving fuel efficiency.

Figure 6:
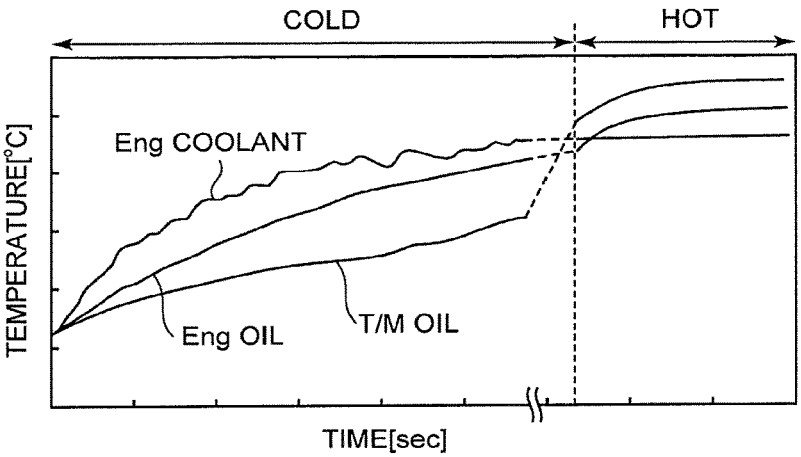
FIG. 6 is a graph showing each temperature transition of the respective fluids during a cold time indicating a state before completion of warming-up (during warming-up) of the engine and the transmission in the vehicle, and during a hot time indicating a state after the completion of the warming-up of the engine and the transmission in the vehicle.

FIG. 6 shows each temperature transition of the respective fluids during a cold time indicating a state before completion of warming-up (during warming-up) of the engine and the transmission in the vehicle and during a hot time indicating a state after the completion of the warming-up of the engine and the transmission in the vehicle. In FIG. 6, a broken line indicates a time point when the warming-up is completed. As shown in FIG. 6, before the completion of the warming-up, the oil temperature of the T/M oil is lower than the oil temperature of the Eng oil. Hence, before the completion of the warming-up, it is necessary to increase the oil temperature of the T/M oil in preference to the oil temperature of the Eng oil, and it is required to increase the heat-exchange amount between the Eng coolant and the T/M oil.

As aforementioned, both before and after the completion of the warming-up of the engine and the transmission in the vehicle, it is necessary to bring the T/M oil to be heat-exchanged with the other fluids in preference to the Eng oil, but in the heat exchanger proposed in JP 2013-113578A, all the fluids are heat-exchanged in parallel; therefore, it is impossible to prioritize the heat-exchange. To cope with this, as shown in FIGS. 1A to 2D, the heat exchanger 1 is configured such that each fifth flow passage 15 is disposed upstream of the flow direction F11 of the Eng coolant in each first flow passage 11, each fourth flow passage 14 is disposed downstream of the flow direction F11 of the Eng coolant in each first flow passage 11, each third flow passage 13 is disposed upstream of the flow direction F14 of the Eng oil in each fourth flow passage 14, each first flow passage 11 is disposed downstream of the flow direction F14 of the Eng oil in each fourth flow passage 14, each second flow passage 12 is disposed upstream of the flow direction F15 of the T/M oil in each fifth flow passage 15, and each first flow passage 11 is disposed downstream of the flow direction F15 of the T/M oil in each fifth flow passage 15 so as to efficiently heat-exchange the T/M oil with the other respective fluids.

In this manner, the heat exchanger 1 can preferentially heat-exchange the T/M oil having a greater variation in loss relative to the variation in oil temperature with the other fluids (the Eng coolant and the Eng oil) by first heat-exchanging the Eng coolant with the T/M oil, and thereafter, heat-exchanging the Eng coolant with the Eng oil. Accordingly, for example, in the transmission during the warming-up, it is possible to rapidly increase the temperature of the T/M oil, thus reducing the loss of the transmission, and enhancing the fuel efficiency of the entire power train.

For example, during the high-speed drive or the high-load drive of the vehicle, the T/M oil in each third flow passage 13 is heat-exchanged with the Eng oil in each fourth flow passage 14 so as to decrease the temperature of the T/M oil; and thereafter, the T/M oil of which temperature is decreased in each fifth flow passage 15 is heat-exchanged with the Eng coolant in each first flow passage 11 that has a lower temperature than that of the Eng oil so as to rapidly cool the T/M oil of which temperature is higher than that of the Eng oil, thereby reducing the loss of the transmission, and enhancing the fuel efficiency of the entire power train.

The flow direction of each fluid in each flow passage will be described with reference to FIG. 7 to FIG. 10, hereinafter. For example, in the heat exchanger 1 as shown in FIGS. 1A 1A to 2D, each of FIG. 7 and FIG. 8 excerpts and illustrates only each first flow passage 11, each fourth flow passage 14, and each fifth flow passage 15 adjacent to one another in the stacking direction of the plates 10. For example, in the heat exchanger 1 as shown in FIGS. 1A to 2D, each of FIG. 9 and FIG. 10 excerpts and illustrates only each second flow passage 12, each third flow passage 13, each fourth flow passage 14 and each fifth flow passage 15 adjacent to one another in the stacking direction of the plates 10.

In each of FIG. 7 to FIG. 10, an alternate long and short dash line arrow indicates a main line (typical flow direction) of the flow direction F11 of the Eng coolant in the case of connecting the first inflow port 111 and the first outflow port 112 with a minimum distance. Solid line arrows respectively indicate a main line of the flow direction F12 of the Eng oil in the case of connecting the second inflow port 121 and the second outflow port 122 with a minimum distance, and a main line of the flow direction F14 of the Eng oil in the case of connecting the fourth inflow port 141 and the fourth outflow port 142 with a minimum distance. Broken line arrows respectively indicate a main line of the flow direction F13 of the T/M oil in the case of connecting the third inflow port 131 and the third outflow port 132 with a minimum distance, and a main line of the flow direction F15 of the T/M oil in the case of connecting the fifth inflow port 151 and the fifth outflow port 152 with a minimum distance.

Figure 8:
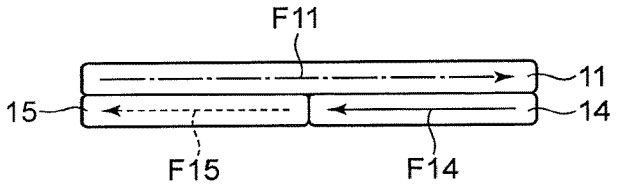
FIG. 8 is a drawing observed along line VIII-VIII of FIG. 7.

As shown in FIG. 7 and FIG. 8, in the heat exchanger 1, the first inflow port 111 and the first outflow port 112, and the fourth inflow port 141 and the fourth outflow port 142 are respectively formed in such a manner that the flow direction F11 of the Eng coolant in each first flow passage 11 and the flow direction F14 of the Eng oil in each fourth flow passage 14 are both in counter-flow relative to each other.

As shown in FIG. 7 and FIG. 8, the above "counter-flow" denotes a state in which main lines of respective flow directions of different fluids intersect each other, or a state in which main lines of respective flow directions of different fluids oppose each other. Flows out of the counter-flow state, that is, flows in a state in which main lines of respective flow directions of different fluids do not intersect each other, and also in a state in which the main lines of the respective flow directions of the different fluids do not oppose each other are called as "co-flow".

Whether or not the flow direction F11 of the Eng coolant in each first flow passage 11 and the flow direction F14 of the Eng oil in each fourth flow passage 14 come into counter-flow relies on the positional relation among the first inflow port 111, the first outflow port 112, the fourth inflow port 141, and the fourth outflow port 142.

Specifically, as shown in FIG. 7, the first inflow port 111 and the first outflow port 112 are formed at respective diagonal positions of corners if the plates 10 configuring each first flow passage 11 is viewed in a plan view. The fourth inflow port 141 and the fourth outflow port 142 are formed at respective diagonal positions of corners if the plates 10 configuring each fourth flow passage 14 is viewed in a plan view, and at these diagonal positions, the main line of the flow direction F14 of the Eng oil intersects the main line of the flow direction F11 of the Eng coolant as viewed in a plan view. For example, in the plate 10 in a rectangular shape as shown in FIG. 7, if the first inflow port 111 and the first outflow port 112 are formed at any diagonal positions of the four corners of the plate 10, the fourth inflow port 141 and the fourth outflow port 142 are formed at diagonal positions of the four corners that are not overlaid with the first inflow port 111 and the first outflow port 112 as viewed in a plan view.

In this manner, in the heat exchanger 1, the main line of the flow direction F11 of the Eng coolant intersects the main line of the flow direction F14 of the Eng oil so that, between the first flow passages 11 and the fourth flow passages 14, the direction in which the Eng coolant flows and the direction in which the Eng oil flows are both in counter-flow relative to each other; therefore, it is possible to maintain the difference in temperature between the fluids partitioned by the plates 10 to be greater compared with the case of the co-flow, thus efficiently heat-exchanging the Eng coolant with the Eng oil.

For example, if the flow directions of the respective fluids are in co-flow, the difference in temperature between these fluids becomes greater on the inlet side (inflow port side) of each fluid, but the difference in temperature between these fluids becomes gradually smaller toward the outlet side (outflow port side) of each fluid; thus the heat exchange efficiency becomes reduced at a whole. To the contrary, if the directions in which the respective fluids flow are in counter-flow relative to each other as with the present disclosure, the difference in temperature between these fluids becomes constant on the inlet side (inflow port side) of each fluid and on the outlet side (outflow port side) of each fluid; therefore, it is possible to maintain the difference in temperature between these fluids to be greater on an average, thus increasing the heat exchange efficiency as a whole.

As shown in FIG. 7 and FIG. 8, in the heat exchanger 1, the first inflow port 111 and the first outflow port 112, and the fifth inflow port 151 and the fifth outflow port 152 are respectively formed such that the flow direction F11 of the Eng coolant in each first flow passage 11 comes into counter-flow relative to the flow direction F15 of the T/M oil in each fifth flow passage 15.

Whether or not the flow direction F11 of the Eng coolant in each first flow passage 11 and the flow direction F15 of the T/M oil in each fifth flow passage 15 come into counter-flow relies on the positional relation among the first inflow port 111, the first outflow port 112, the fifth inflow port 151, and the fifth outflow port 152.

Specifically, as shown in FIG. 7, the first inflow port 111 and the first outflow port 112 are formed at diagonal positions of the corners if the plates 10 configuring each first flow passage 11 is viewed in a plan view. The fifth inflow port 151 and the fifth outflow port 152 are formed at diagonal positions of corners if the plates 10 configuring each fifth flow passage 15 is viewed in a plan view, and at these diagonal positions, the main line of the flow direction F15 of the T/M oil intersects the main line of the flow direction F11 of the Eng coolant as viewed in a plan view. For example, in the plate 10 in a rectangular shape as shown in FIG. 7, if the first inflow port 111 and the first outflow port 112 are formed at any diagonal positions of the four corners of the plate 10, the fifth inflow port 151 and the fifth outflow port 152 are formed at diagonal positions of the four corners that are not overlaid with the first inflow port 111 and the first outflow port 112 as viewed in a plan view.

In this manner, in the heat exchanger 1, the main line of the flow direction F11 of the Eng coolant intersects the main line of the flow direction F15 of the T/M oil so that, between the first flow passages 11 and the fifth flow passages 15, the direction in which the Eng coolant flows and the direction in which the T/M oil flows are both in counter-flow relative to each other; therefore, it is possible to maintain the difference in temperature between the fluids partitioned by the plates 10 to be greater compared with the case of the co-flow, thus efficiently heat-exchanging the Eng coolant with the T/M oil.

Figure 10:
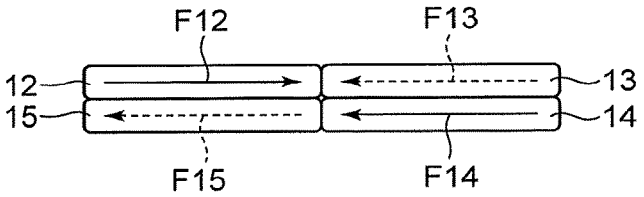
FIG. 10 is a drawing observed along line X-X of FIG. 9.

As shown in FIG. 9 and FIG. 10, in the heat exchanger 1, the second inflow port 121 and the second outflow port 122, and the fifth inflow port 151 and the fifth outflow port 152 are respectively formed in such a manner that the flow direction F12 of the Eng oil in each second flow passage 12 and the flow direction F15 of the T/M oil in each fifth flow passage 15 are in counter-flow relative to each other.

Whether or not the flow direction F12 of the Eng oil in each second flow passage 12 and the flow direction F15 of the T/M oil in each fifth flow passage 15 come into counter-flow relies on the positional relation among the second inflow port 121, the second outflow port 122, the fifth inflow port 151, and the fifth outflow port 152.

Specifically, as shown in FIG. 9, the second inflow port 121 and the second outflow port 122 are formed at diagonal positions of the corners if the plates 10 configuring each second flow passage 12 is viewed in a plan view. The fifth inflow port 151 and the fifth outflow port 152 are formed at diagonal positions of the corners if the plates 10 configuring each fifth flow passage 15 is viewed in a plan view, and at these diagonal positions, the main line of the flow direction F15 of the T/M oil intersects the main line of the flow direction F12 of the Eng oil as viewed in a plan view. For example, in the plate 10 in a rectangular shape as shown in FIG. 9, if the second inflow port 121 and the second outflow port 122 are formed at any diagonal positions of the four corners of the plate 10, the fifth inflow port 151 and the fifth outflow port 152 are formed at diagonal positions of the four corners that are not overlaid with the second inflow port 121 and the second outflow port 122 as viewed in a plan view.

In this manner, in the heat exchanger 1, the main line of the flow direction F12 of the Eng oil intersects the main line of the flow direction F15 of the T/M oil so that, between the second flow passages 12 and the fifth flow passages 15, the direction in which the Eng oil flows and the direction in which the T/M oil flows are both in counter-flow relative to each other; therefore, it is possible to maintain the difference in temperature between the fluids partitioned by the plates 10 to be greater compared with the case of the co-flow, thus efficiently heat-exchanging the Eng oil with the T/M oil.

As shown in FIG. 9 and FIG. 10, in the heat exchanger 1, the fourth inflow port 141 and the fourth outflow port 142, and the third inflow port 131 and the third outflow port 132 are respectively formed in such a manner that the flow direction F14 of the Eng oil in each fourth flow passage 14 and the flow direction F13 of the T/M oil in each third flow passage 13 are in counter-flow relative to each other.

Whether or not the flow direction F14 of the Eng oil in each fourth flow passage 14 and the flow direction F13 of the T/M oil in each third flow passage 13 come into counter-flow relies on the positional relation among the fourth inflow port 141, the fourth outflow port 142, the third inflow port 131, and the third outflow port 132.

Specifically, as shown in FIG. 9, the fourth inflow port 141 and the fourth outflow port 142 are formed at diagonal positions of the corners if the plates 10 configuring each fourth flow passage 14 is viewed in a plan view. The third inflow port 131 and the third outflow port 132 are formed at diagonal positions of corners if the plates 10 configuring each third flow passage 13 is viewed in a plan view, and at these diagonal positions, the main line of the flow direction F13 of the T/M oil intersects the main line of the flow direction F14 of the Eng oil as viewed in a plan view. For example, in the plate 10 in a rectangular shape as shown in FIG. 9, if the fourth inflow port 141 and the fourth outflow port 142 are formed at any diagonal positions of the four corners of the plate 10, the third inflow port 131 and the third outflow port 132 are formed at diagonal positions of the four corners that are not overlaid with the fourth inflow port 141 and the fourth outflow port 142 as viewed in a plan view.

In this manner, in the heat exchanger 1, the main line of the flow direction F14 of the Eng oil intersects the main line of the flow direction F13 of the T/M oil so that, between the fourth flow passages 14 and the third flow passages 13, the direction in which the Eng oil flows and the direction in which the T/M oil flows are both in counter-flow relative to each other; therefore, it is possible to maintain the difference in temperature between the fluids partitioned by the plates 10 to be greater compared with the case of the co-flow, thus efficiently heat-exchanging the Eng oil with the T/M oil.

Figure 11A:
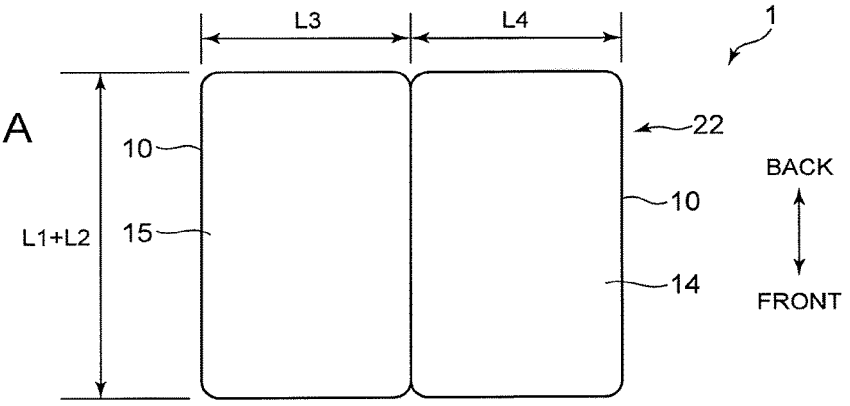
FIGS. 11A to 11B are schematic drawings showing a width of each flow passage in the heat exchanger according to the embodiment, and showing a plan view and a bottom view thereof in order from the top.
Figure 11B:
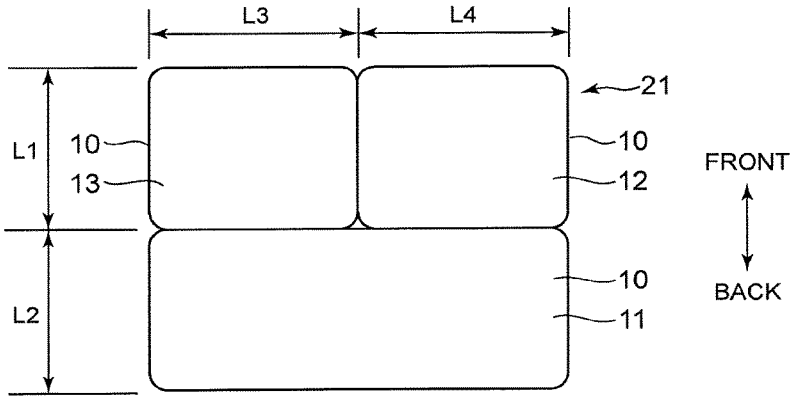

With respect to the areas of the respective flow passages in the heat exchanger 1, it is possible to optimize the widths L1 to L4 of the respective flow passages in each layer if the heat exchanger 1 is viewed in a plan view, depending on the heat exchange amount required in each fluid, as shown in FIGS. 11A to 11B for example. For example, as shown in these drawings, if the widths L1 to L4 of the respective flow passages in each layer are set to be equal to one another (L1=L2=L3=L4), it is possible to configure the heat exchanger 1 to be in a square shape as viewed in a plan view, thereby promoting enhancement of mountability thereof to the vehicle.

The specific configurations of the heat exchanger 1, that is, the shape and the stacking method of the plates 10 are not limited to specific ones, and the shape and the stacking method of the plates 10 may be appropriately defined so as to provide the arrangements of the respective flow passages; and an example thereof may include the case of utilizing dish-shaped plates.

In this case, the following three types of plates may be used as the plates 10: large dish-shaped plates that partition the respective first flow passages 11, the respective fourth flow passages 14, and the respective fifth flow passages 15; small dish-shaped plates that partition the respective second flow passages 12 and the respective third flow passages 13; and a flat plate that functions as an uppermost cover member, and these plates are combined (stacked) to form the respective flow passages. As the first communicating passage 16 and the second communicating passage 17, pipes made of metal, such as aluminum, may be used, for example. The "disk-shape" herein denotes a shape in which a flat surface is formed to be concave, an aperture is formed above the concave portion, and there are a bottom surface and a side surface. An adhesive agent is applied between the plates 10, and these plates 10 are subjected to heat treatment or the like so as to be integrally bonded into the heat exchanger 1.

In the heat exchanger 1 having the aforementioned configuration, the respective flow passages are arranged in consideration of the variation in loss relative to each variation in oil temperature of the Eng oil and the T/M oil, thereby optimizing the respective heat-exchange amounts of the Eng coolant, the Eng oil, and the T/M oil; therefore, it is possible to reduce the loss of the engine and the transmission, and enhance the fuel efficiency of the entire power train.

In the heat exchanger as proposed in JP 2013-113578 A, each flow passage through which the Eng oil flows, each flow passage through which the Eng coolant flows, and each flow passage through which the T/M oil flows are stacked in this order; thus at least three layers are required to carry out the heat exchange among three types of fluids. To the contrary, in the heat exchanger 1 according to the present embodiment, each first flow passage 11 through which the Eng coolant flows, each second flow passage 12 through which the Eng oil flows, and each third flow passage 13 through which the T/M oil flows are arranged in the same layer, and each fourth flow passage 14 through which the Eng oil flows and each fifth flow passage 15 through which the T/M oil flows are arranged in the same layer; thus it is possible to carry out the heat exchange among three types of fluids in at least two layers. Accordingly, compared with the heat exchanger as disclosed in JP 2013-113578 A, in the heat exchanger 1, it is possible to reduce the number of the plates 10 used for forming the flow passages of the respective fluids, thereby reducing the layers of the heat exchanger 1, and configuring the heat exchanger 1 to be compact.

In the heat exchanger as proposed in JP 2013-113578 A, since the heat exchange is simultaneously carried out among the Eng coolant, the Eng oil, and the T/M oil, the respective heat-exchange amounts of these fluids might be decreased, which results in deterioration of the fuel efficiency. Specifically, since each fluid flows in each layer in parallel, the flow rate of each fluid in each layer becomes decreased, and thus the heat exchange amount of each fluid becomes smaller. In particular, the T/M oil has a smaller flow rate than those of the Eng coolant and the Eng oil; therefore, in the heat exchanger of the related art, it might be impossible to satisfy the required heat-exchange amount. Even if the flow passages are designed to satisfy the heat-exchange amount required in the T/M oil having the smallest flow rate, in the case of the heat exchanger of the related art, the respective flow passages through which the fluids other than the T/M oil flow necessarily become enlarged in accordance with increase in dimension of the flow passage through which the T/M oil flows, which results in increase in dimension of the entire heat exchanger. To the contrary, the heat exchanger 1 is configured such that the respective flow passages are so arranged as to satisfy the heat-exchange amount required in the T/M oil; therefore, it is possible to suppress increase in dimension of the entire heat exchanger.

In the heat exchanger as proposed in JP 2013-113578 A, it is impossible to arrange all the flow directions of the respective fluids to be in counter-flow relative to one another, so that the flow directions of some of the fluids come into co-flow. To the contrary, in the heat exchanger 1, as shown in FIGS. 2A to 2D, each fifth flow passage 15 is arranged upstream of the flow direction F11 of the Eng coolant in each first flow passage 11, each fourth flow passage 14 is arranged downstream of the flow direction F11 of the Eng coolant in each first flow passage 11, each third flow passage 13 is arranged upstream of the flow direction F14 of the Eng oil in each fourth flow passage 14, each first flow passage 11 is arranged downstream of the flow direction F14 of the Eng oil in each fourth flow passage 14, each second flow passage 12 is arranged upstream of the flow direction F15 of the T/M oil in each fifth flow passage 15, and each first flow passage 11 is arranged downstream of the flow direction F15 of the T/M oil in each fifth flow passage 15, thereby arranging all the flow directions of the respective fluids to be in counter-flow relative to one another. Accordingly, in the heat exchanger 1, the respective fluids can be more efficiently heat-exchanged with one another, compared with the heat exchanger in which some of the flow passages are arranged in co-flow.

In the conventional heat exchanger as proposed in JP 2013-113578 A, the number of the plates configuring each flow passage is identical; thus it is impossible to set the heat-exchange amount of each fluid to be an optimum value, which causes deficiency and excess of the heat-exchange amount. To the contrary, the heat exchanger 1 can set the heat-exchange amount of each fluid to be an optimum value by appropriately arranging the location of each flow passage.

Figure 12:
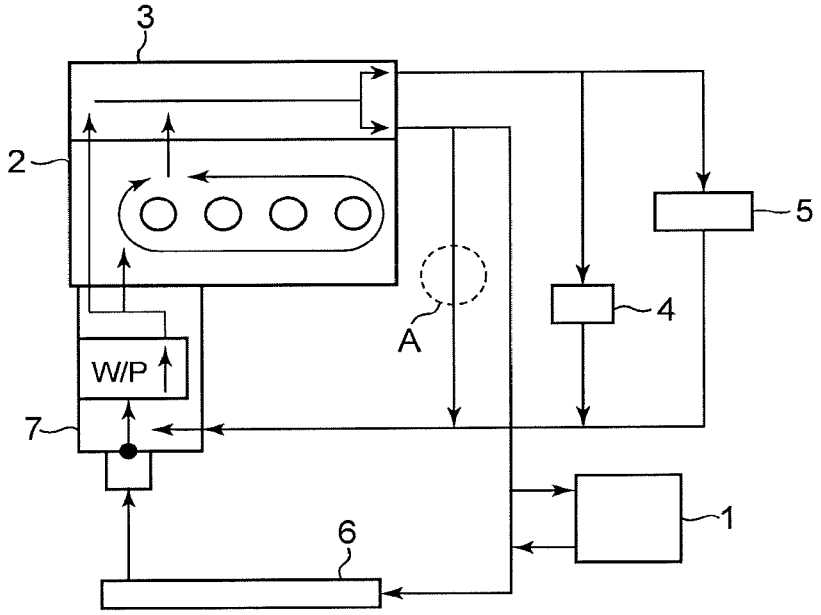
FIG. 12 is a drawing showing an example of an arrangement position in the vehicle of the heat exchanger according to the embodiment.

An arrangement position of the heat exchanger will be described, hereinafter. It is preferable to arrange the heat exchanger 1 at a position at which the flow rate of the Eng coolant is greater in the vehicle, and may be disposed in a radiator passage, as shown in FIG. 12, for example. In this drawing, there are respectively illustrated a cylinder block 2, a cylinder head 3, a throttle body 4, a heater 5, a radiator 6, and a thermostat 7 of the engine in the vehicle. In this drawing, each arrow illustrated between each two adjacent component elements indicates a passage through which each fluid (the Eng coolant, the Eng oil, the T/M oil) flows. The "flow rate of the Eng coolant is greater" denotes the case of the Eng coolant having an average flow rate of not less than 6 L/min, for example.

As shown in FIG. 12, the heat exchanger is disposed in the vicinity of an inlet of the radiator 6 so as to supply the heat exchanger 1 with more Eng coolant, thereby enhancing the heat exchange amount of each fluid. In the case of disposing the heat exchanger 1 at the position as shown in FIG. 12, the thermostat 7 is in a closed state before the completion of the engine warming-up, which means that the Eng coolant is not sufficiently heated, and thus the heat exchanger 1 is supplied with no Eng coolant, and no heat exchange is carried out among the respective fluids. On the other hand, after the completion of the engine warming-up, which means that if the Eng coolant is sufficiently heated, the thermostat 7 is opened so as to supply the heat exchanger 1 with the Eng coolant, and thus the heat exchange is carried out among the respective fluids. Accordingly, if the heat exchanger 1 is disposed at the position as shown in FIG. 12, it is possible to automatically carry out switching between inexecution and execution of the heat exchange among the respective fluids before and after the completion of the engine warming-up.

In general, before the completion of the engine warming-up, it is preferable to preferentially increase the temperature of the Eng coolant in light of enhancement of the fuel efficiency; therefore, as shown in FIG. 12, the heat exchanger 1 may be disposed in the vicinity of the inlet of the radiator 6 so as to enhance the fuel efficiency.

Besides the above position, the heat exchanger 1 may be disposed at a position immediately after the cylinder head 3 as indicated by a reference numeral A of FIG. 12. The flow rate of the Eng coolant is also great enough at this position to enhance the heat-exchange amount of each fluid. In this case, the second inflow port 121 and the second outflow port 122 may be directly mounted to the cylinder head 3, for example.

As described above, the embodiment of the heat exchanger has been specifically explained, and the spirit of the present disclosure is not limited to the above descriptions, but rather is construed broadly within its spirit and scope of the claims. It is needless to mention that various changes and modifications, and others made based on the descriptions may be included in the spirit of the disclosure.

For example, in FIGS. 1A to 2D as described above, there has been explained the heat exchanger 1 that has twelfth layers in total configured by alternately arranging the triple-flow-passage arrangement layers 21 and the dual-flow-passage arrangement layers 22 in the stacking direction of the plates 10, but the number of layers of the heat exchanger 1 may be twelve or more, or twelve or less as far as the triple-flow-passage arrangement layers 21 and the dual-flow-passage arrangement layers 22 are alternately arranged.

What is claimed is:

1. A heat exchanger for a vehicle, the vehicle including an engine and a transmission, the heat exchanger comprising:

first flow passages configured to bring an engine coolant to flow through the first flow passages;

second flow passages configured to bring an engine oil to flow through the second flow passages;

third flow passages configured to bring a transmission oil to flow through the third flow passages;

fourth flow passages configured to bring the engine oil having flowed through the second flow passages to flow through the fourth flow passages;

fifth flow passages configured to bring the transmission oil having flowed through the third flow passages to flow through the fifth flow passages;

a plurality of plates configured to partition the first flow passages, the second flow passages, the third flow passages, the fourth flow passages, and the fifth flow passages;

a first communicating passage configured to communicate the second flow passages with the fourth flow passages; and a second communicating passage configured to communicate the third flow passages with the fifth flow passages;

wherein the first flow passages are configured to bring the engine coolant to be heat-exchanged with both the engine oil in the fourth flow passages and the transmission oil in the fifth flow passages via the plates, the fourth flow passages are configured to bring the engine oil to be heat-exchanged with both the transmission oil in the third flow passages and the engine coolant in the first flow passages via the plates, the fifth flow passages are configured to bring the transmission oil to be heat-exchanged with both the engine oil in the second flow passages and the engine coolant in the first flow passages via the plates, triple-flow-passage arrangement layers in each of which each first flow passage, each second flow passage, and each third flow passage are disposed in the same layer, and dual-flow-passage arrangement layers in each of which each fourth flow passage and each fifth flow passage are disposed in the same layer are alternately arranged in a stacking direction of the plates in such a manner that flow passages of the same type are not overlaid with one another in the stacking direction of the plates, each fifth flow passage is disposed upstream of a flow direction of the engine coolant in each first flow passage, each fourth flow passage is disposed downstream of the flow direction of the engine coolant in each first flow passage, each third flow passage is disposed upstream of a flow direction of the engine oil in each fourth flow passage, each first flow passage is disposed downstream of the flow direction of the engine oil in each fourth flow passage, each second flow passage is disposed upstream of a flow direction of the transmission oil in each fifth flow passage, and each first flow passage is disposed downstream of the flow direction of the transmission oil in each fifth flow passage.

2. The heat exchanger according to claim 1, wherein an inflow port and an outflow port of the engine coolant in the first flow passage, and an inflow port and an outflow port of the engine oil in the fourth flow passage are arranged such that the flow direction of the engine coolant in each first flow passage and the flow direction of the engine oil in each fourth flow passage are in counter-flow relative to each other.

3. The heat exchanger according to claim 1, wherein an inflow port and an outflow port of the engine coolant in the first flow passage, and an inflow port and an outflow port of the transmission oil in the fifth flow passage are arranged such that the flow direction of the engine coolant in each first flow passage and the flow direction of the transmission oil in each fifth flow passage are in counter-flow relative to each other.

4. The heat exchanger according to claim 1, wherein an inflow port and an outflow port of the engine oil in the second flow passage, and an inflow port and an outflow port of the transmission oil in the fifth flow passage are arranged such that the flow direction of the engine oil in each second flow passage and the flow direction of the transmission oil in each fifth flow passage are in counter-flow relative to each other.

5. The heat exchanger according to claim 1, wherein an inflow port and an outflow port of the engine oil in the fourth flow passage, and an inflow port and an outflow port of the transmission oil in the third flow passage are arranged such that the flow direction of the engine oil in each fourth flow passage and the flow direction of the transmission oil in each third flow passage are in counter-flow relative to each other.

* * * * *